US011050179B2

(12) United States Patent
Chen et al.

(10) Patent No.: US 11,050,179 B2
(45) Date of Patent: Jun. 29, 2021

(54) ELECTRICAL CONNECTOR HAVING A CONTACT FORMED OF FIRST AND SECOND CONTACT PARTS COUPLED TOGETHER

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Ding-Cherng Chen, New Taipei (TW); Chien-Jen Ting, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 21 days.

(21) Appl. No.: 16/408,383

(22) Filed: May 9, 2019

(65) Prior Publication Data

US 2019/0348788 A1 Nov. 14, 2019

(30) Foreign Application Priority Data

May 11, 2018 (CN) ..... 201820699797.2
May 11, 2018 (CN) ..... 201820699816.1

(51) Int. Cl.

| | |
|---|---|
| ***H01R 24/00*** | (2011.01) |
| ***H01R 13/405*** | (2006.01) |
| ***H01R 13/502*** | (2006.01) |
| ***H01R 12/55*** | (2011.01) |

(52) U.S. Cl.
CPC ..... *H01R 13/405* (2013.01); *H01R 12/55* (2013.01); *H01R 13/502* (2013.01)

(58) Field of Classification Search
CPC .. H01R 13/2492; H01R 12/721; H01R 12/55; H01R 12/57; H01R 13/405; H01R 13/502; H01R 13/2442
USPC ..... 439/630
See application file for complete search history.

(56) References Cited

U.S. PATENT DOCUMENTS

| | | | | |
|---|---|---|---|---|
| 6,805,589 | B2 | 10/2004 | Lee | |
| 8,167,658 | B1 * | 5/2012 | Liu | H01R 27/02 439/630 |
| 10,637,175 | B1 * | 4/2020 | Zou | H01R 12/721 |
| 2002/0187666 | A1 * | 12/2002 | Harasawa | H01R 13/2442 439/74 |
| 2010/0081333 | A1 * | 4/2010 | Yang | H01R 13/2442 439/638 |

(Continued)

FOREIGN PATENT DOCUMENTS

| | | |
|---|---|---|
| CN | 2409628 | 12/2000 |
| CN | 203631889 | 6/2014 |

*Primary Examiner* — Hae Moon Hyeon
(74) *Attorney, Agent, or Firm* — Ming Chieh Chang; Wei Te Chung

(57) ABSTRACT

An electrical connector includes: a terminal module including an insulative body and plural first contacts secured to the insulative body, each first contact having a leg and a first terminating portion; plural second contacts each having a second terminating portion coupled to the first terminating portion of a corresponding first contact and a contacting portion extending from the second terminating portion rearwardly toward the leg of the corresponding first contact.

17 Claims, 12 Drawing Sheets

(56) References Cited

U.S. PATENT DOCUMENTS

| | | | | |
|---|---|---|---|---|
| 2010/0216345 | A1* | 8/2010 | Kiryu | H01R 27/00 439/630 |
| 2010/0248551 | A1* | 9/2010 | Harada | H01R 27/00 439/636 |
| 2015/0207251 | A1* | 7/2015 | Fan | H01R 12/737 439/630 |
| 2018/0097320 | A1* | 4/2018 | Hashiguchi | H01R 24/60 |
| 2019/0237884 | A1* | 8/2019 | Wang | H01R 13/2492 |

* cited by examiner

ELECTRICAL CONNECTOR HAVING A CONTACT FORMED OF FIRST AND SECOND CONTACT PARTS COUPLED TOGETHER

BACKGROUND OF THE INVENTION

1. Field of the Invention

The present invention relates to an electrical connector including contacts designed to be constructed of two parts coupled to each other.

2. Description of Related Arts

U.S. Pat. No. 6,805,589 discloses an electrical connector comprising, among others, a seat body including a bottom board section and a top board section and multiple top and bottom terminals secured to the bottom and top board sections. Terminals secured to the top board section are designed to have two parts coupled to each other. Specifically, a connecting terminal is provided and secured to the bottom board section and has a soldering leg and another end coupled to a terminating end of a top terminal.

SUMMARY OF THE INVENTION

An electrical connector comprises: a terminal module including an insulative body and a plurality of first contacts secured to the insulative body, each first contact having a leg and a first terminating portion; a plurality of second contacts each having a second terminating portion coupled to the first terminating portion of a corresponding first contact and a contacting portion extending from the second terminating portion rearwardly toward the leg of the corresponding first contact.

DETAILED DESCRIPTION OF THE PREFERRED EMBODIMENTS

Figure 1:
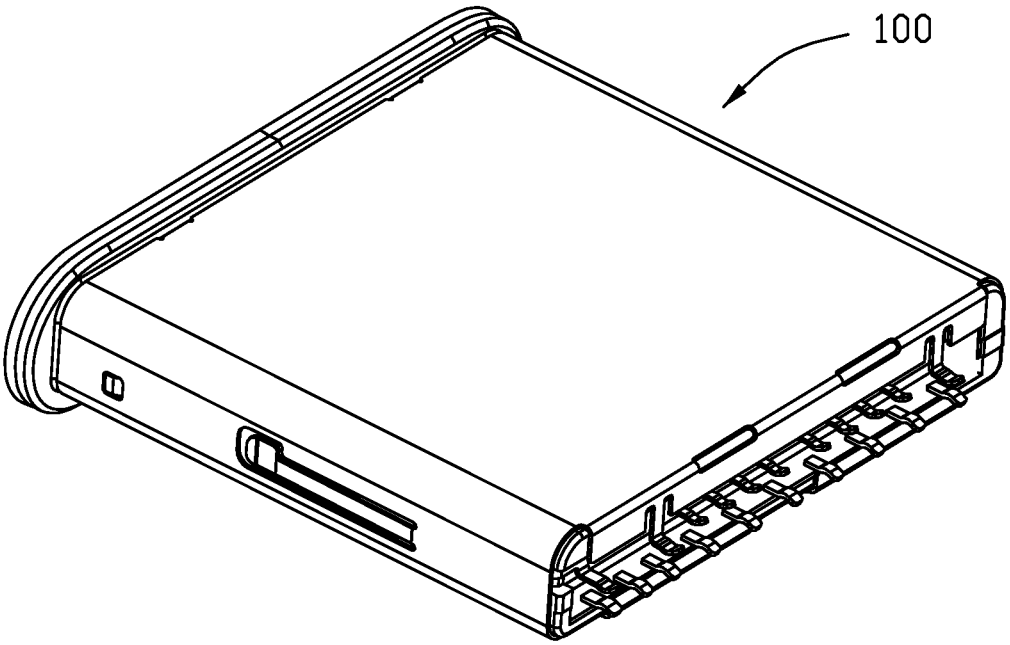
FIG. 1 is a rear perspective view of an electrical connector in accordance with the present invention.
Figure 2:
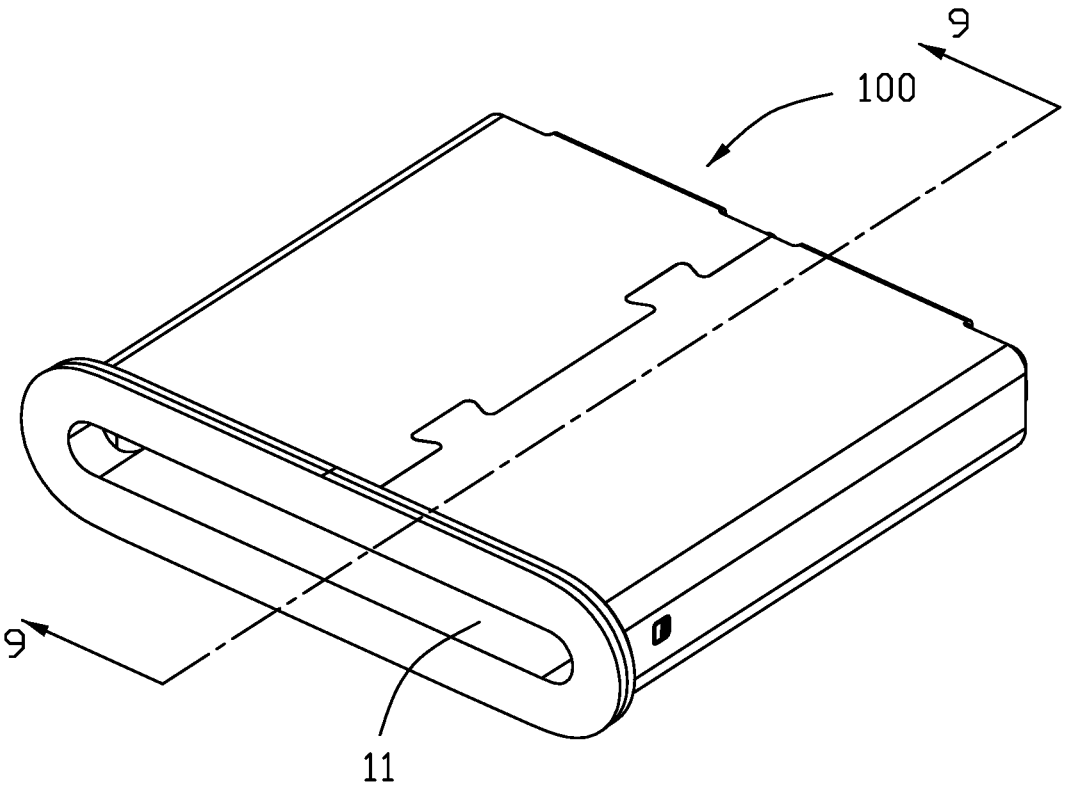
FIG. 2 is a front perspective view of the electrical connector.
Figure 3:
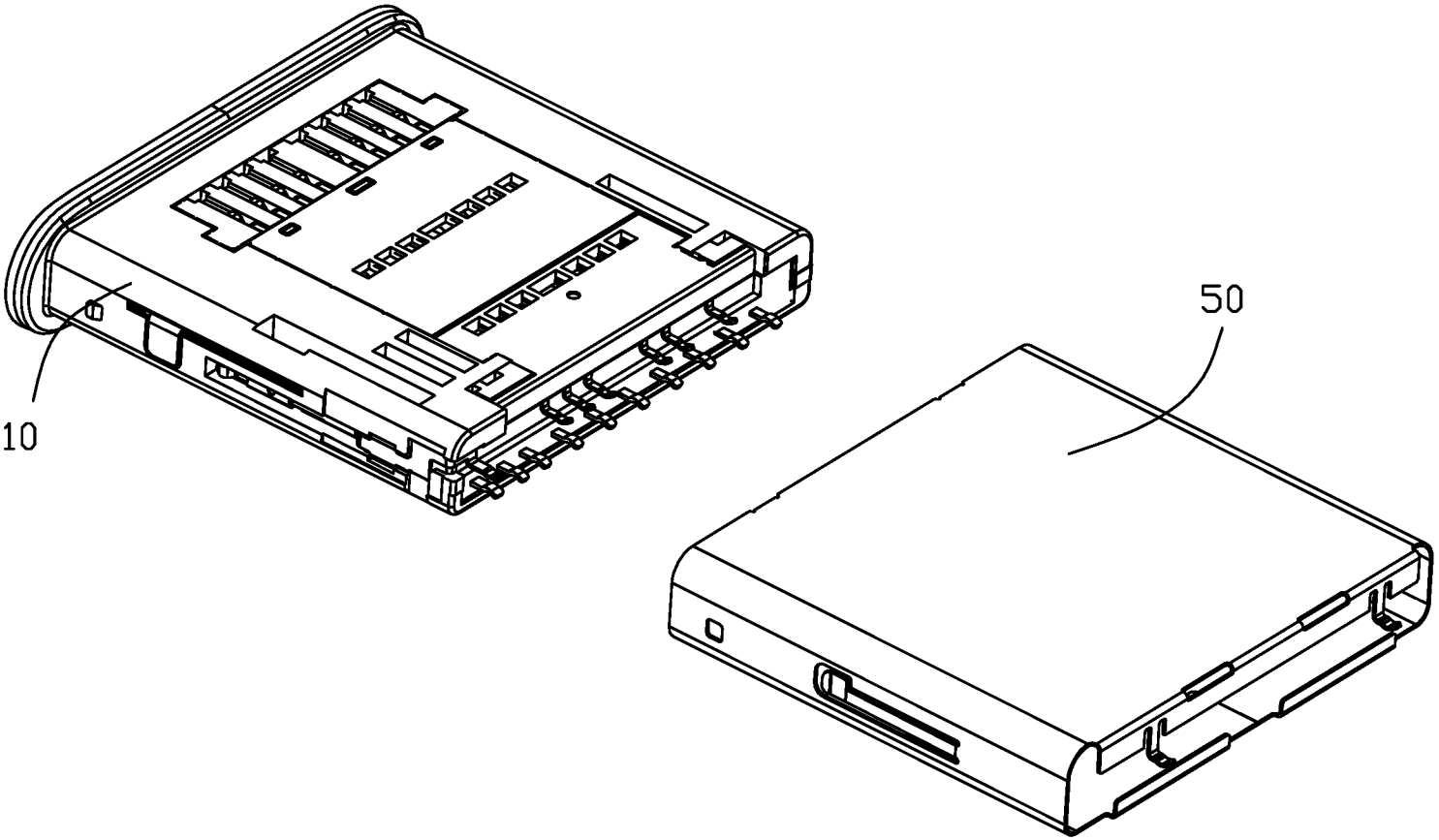
FIG. 3 is an exploded view of FIG. 1.
Figure 4:
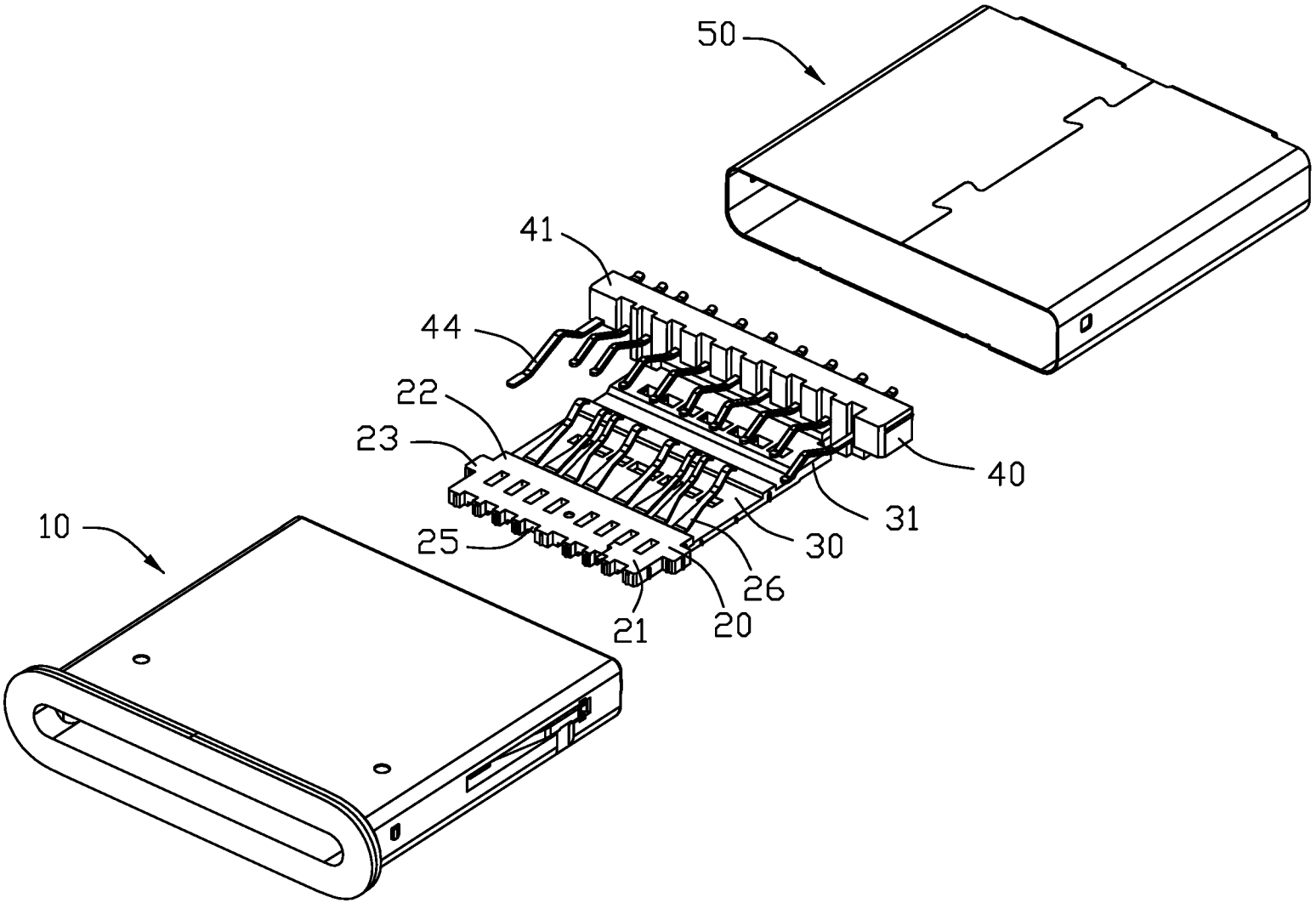
FIG. 4 is a further exploded view of FIG. 2.
Figure 5:
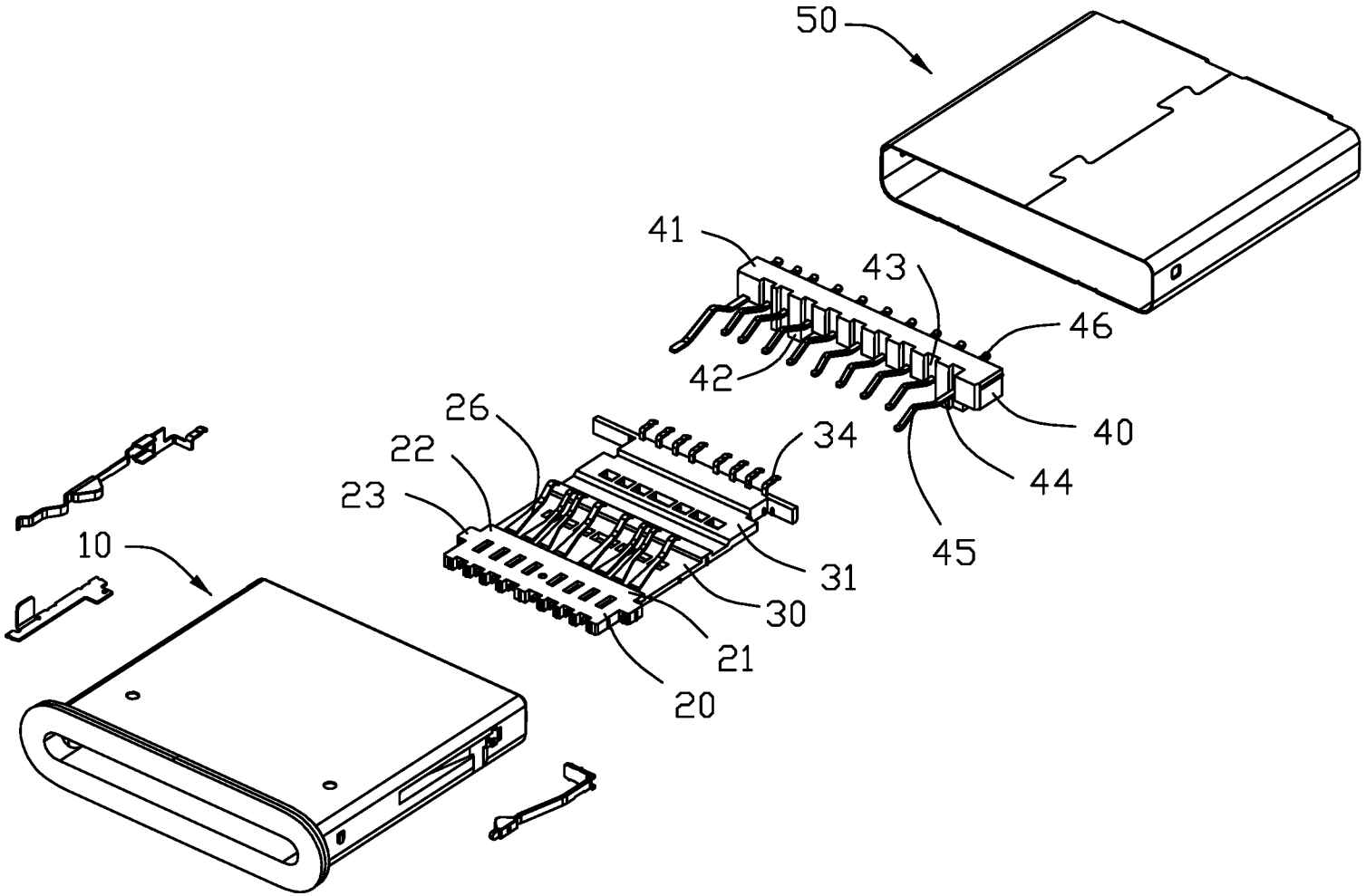
FIG. 5 is a further exploded view of FIG. 4.
Figure 6:
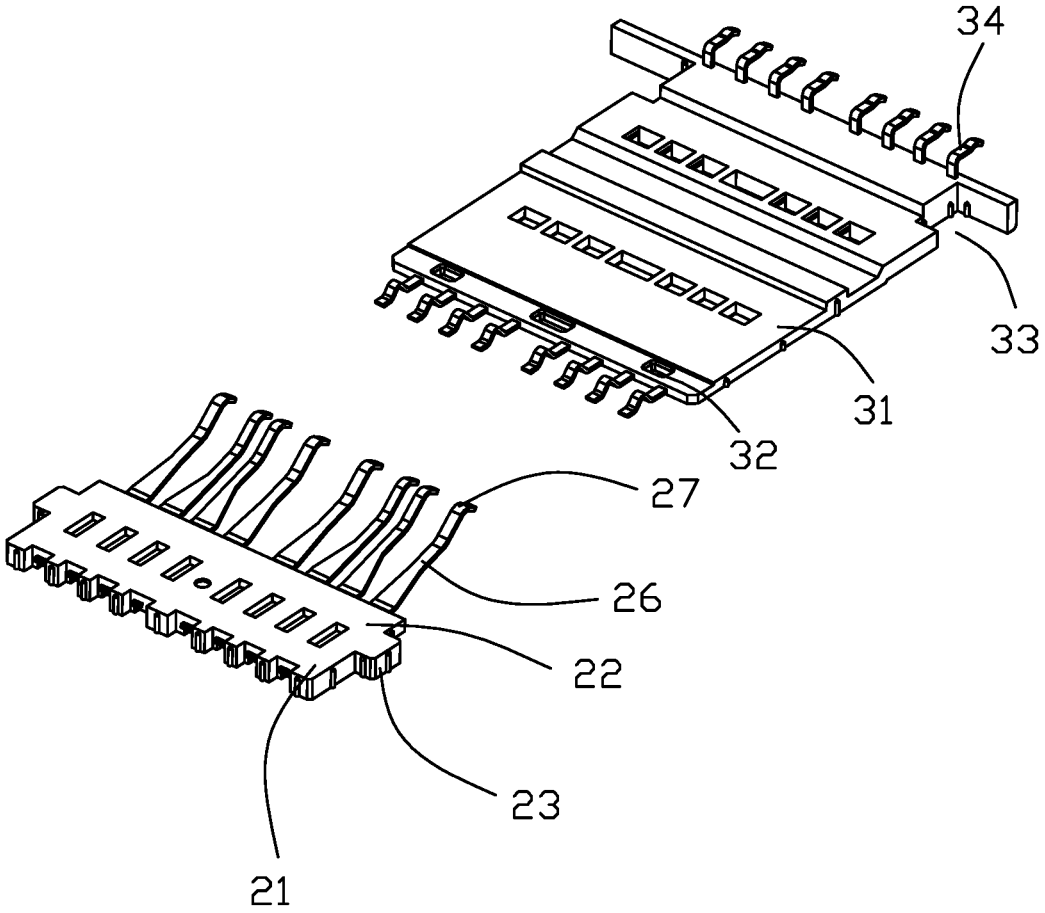
FIG. 6 is an exploded view of a first and a second terminal modules of the electrical connector.
Figure 7:
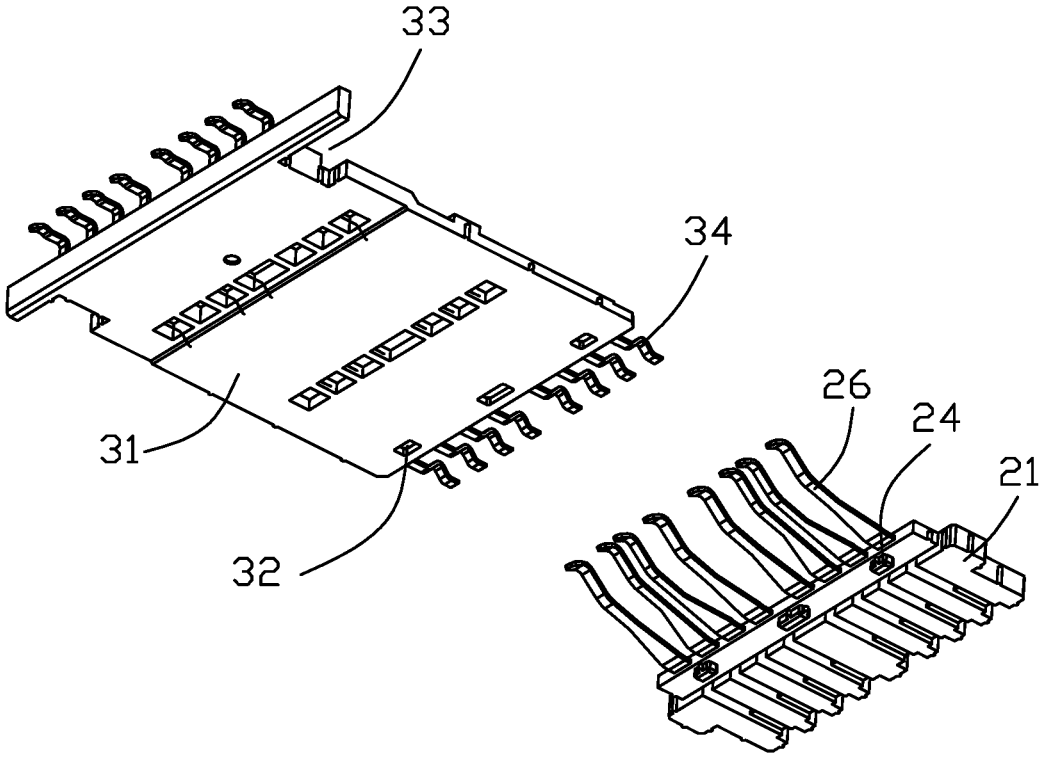
FIG. 7 is a view similar to FIG. 6 but from a different perspective.
Figure 8:
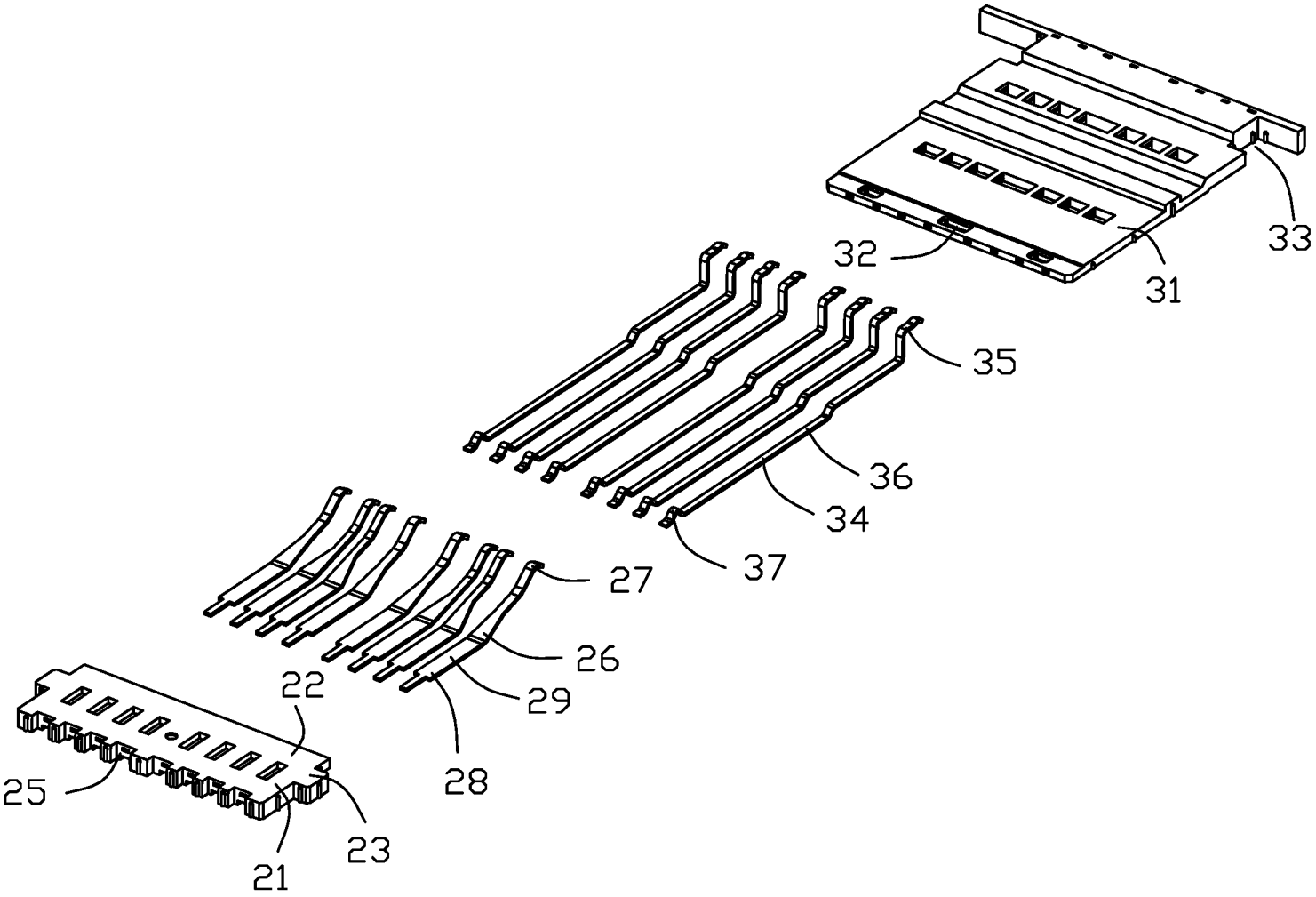
FIG. 8 is a further exploded view of FIG. 6.
Figure 9:
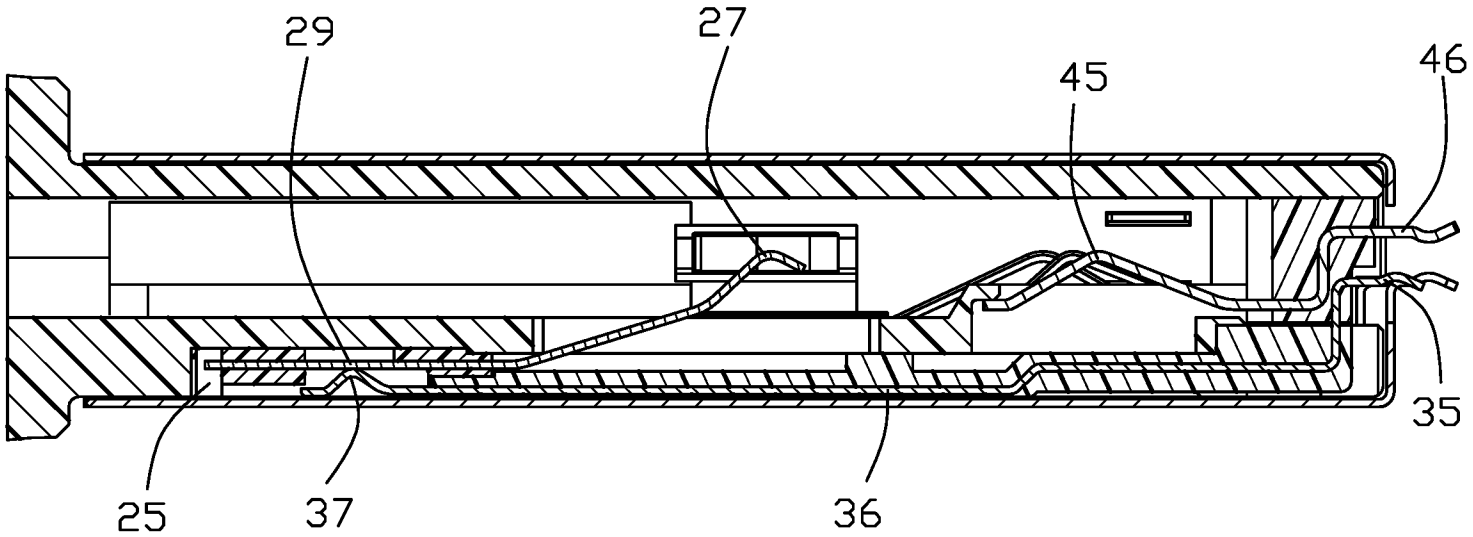
FIG. 9 is a cross-sectional view of the electrical connector taken along line A-A in FIG. 2.

Referring to FIGS. 1-4, an electrical connector 100 of a first embodiment comprises an insulative housing 10, a first terminal module 20, a second terminal module 30, and a third terminal module 40 received in the insulative housing, and a shielding shell 50 enclosing the insulative housing. The insulative housing 10 has a receiving space 11 open toward a front thereof for receiving a mating memory card or card tray.

Referring to FIGS. 5-9, the first terminal module 20 and the second terminal module 30 are stacked and secured to the insulative housing 10. The third terminal module 40 is secured to the second terminal module 30 behind the first terminal module 20. The first terminal module 20 includes an insulative base 21 and a plurality of terminals 26 secured to the insulative base 21 via an insert-molding process and functioning as a front row contacts. The terminal 26 has a resilient contacting portion 27 extending rearwardly into the receiving space 11 and a planar immovable terminating portion 28. The terminating portion 28 is partially exposed through a bottom of the insulative base 21 to define a coupling portion 29. The second terminal module 30 includes an insulative body 31 attached to the housing 10 in the vertical direction, and a plurality of terminals 34 secured to the insulative body 31 via an insert-molding process and functioning as supporting terminals or stationary terminals. The terminal 34 has a leg 35, an intermediate securing portion 36, and a terminating portion 37 for resiliently pressing against the coupling portion 29 of the terminal 26 to complete a functional terminal constructed of two parts in order to simplify its manufacturing process. The insulative body 31 has holes 32 and the insulative base 21 has posts 24 interference fit in the holes. The insulative base 21 has a main part 22 and a pair of protrusions 23 for interference fitting with the insulative housing 10. The third terminal module 40 includes an insulative body 41 and a plurality of terminals 44 secured to the insulative body via an insert-molding process and functioning as a rear row contacts. The insulative body 41 has two end blocks 42 engaged in corresponding notches 33 of the insulative body 31, thereby securing the insulative body 41 to the insulative body 31. The terminal 44 has a contacting portion 45 and a leg 46. The contacting portions 45 are lined behind the contacting portions 27. The contacting portions 27 and the contacting portions 45 extend toward each other and apexes thereof substantially lie on a same plane. The legs 35 may engage the insulative body 41 if desired. The legs 46 are located above the legs 35. The insulative base 21 has front vertical slots 25 for exposing ends of the terminating portions 28 of the terminals 26. The insulative body 41 has front vertical slots 43 where the contacting portions 45 extend out forwardly into the receiving space 11.

Figure 10:
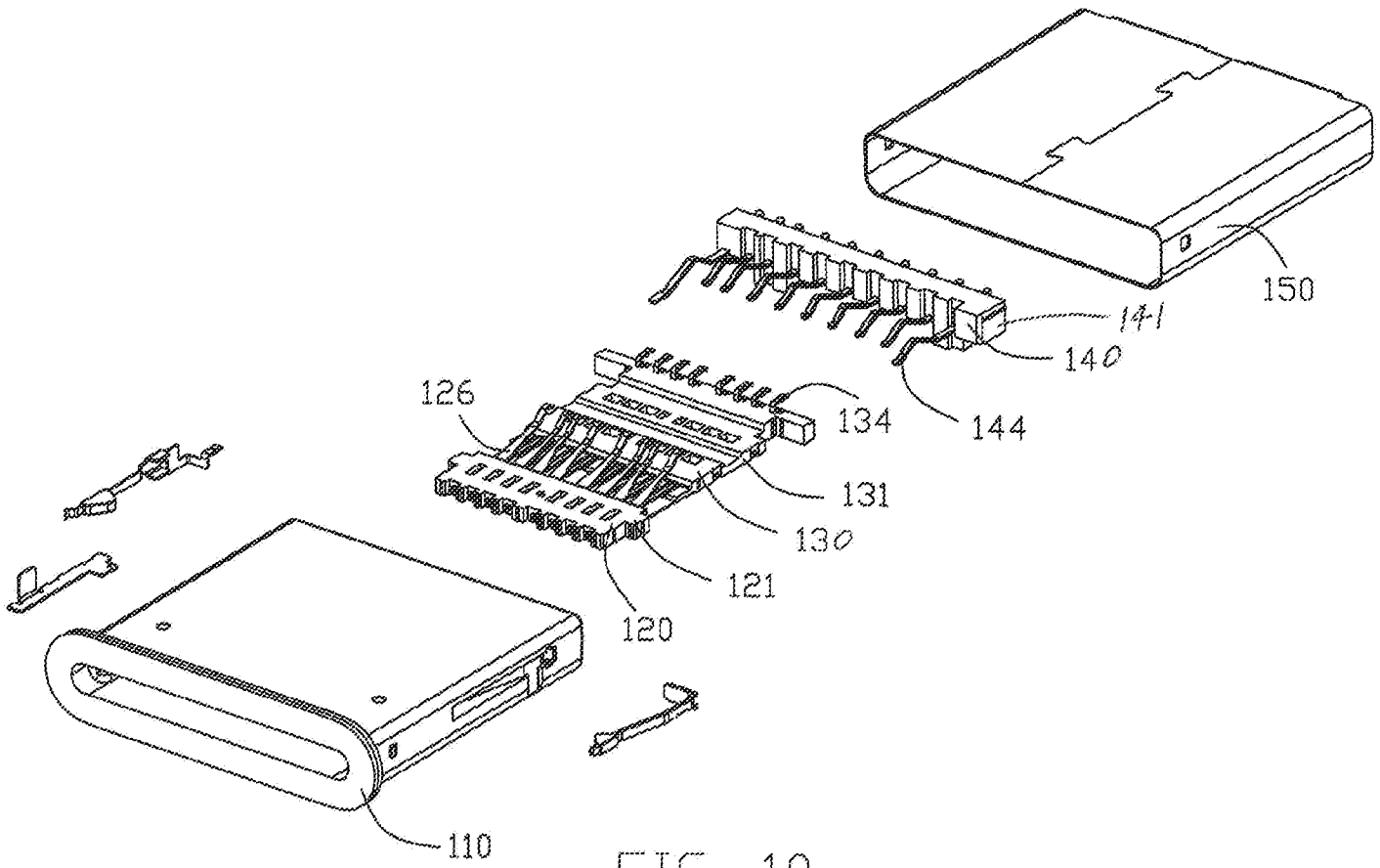
FIG. 10 is a view similar to FIG. 5 but showing a varied design of the electrical connector.
Figure 11:
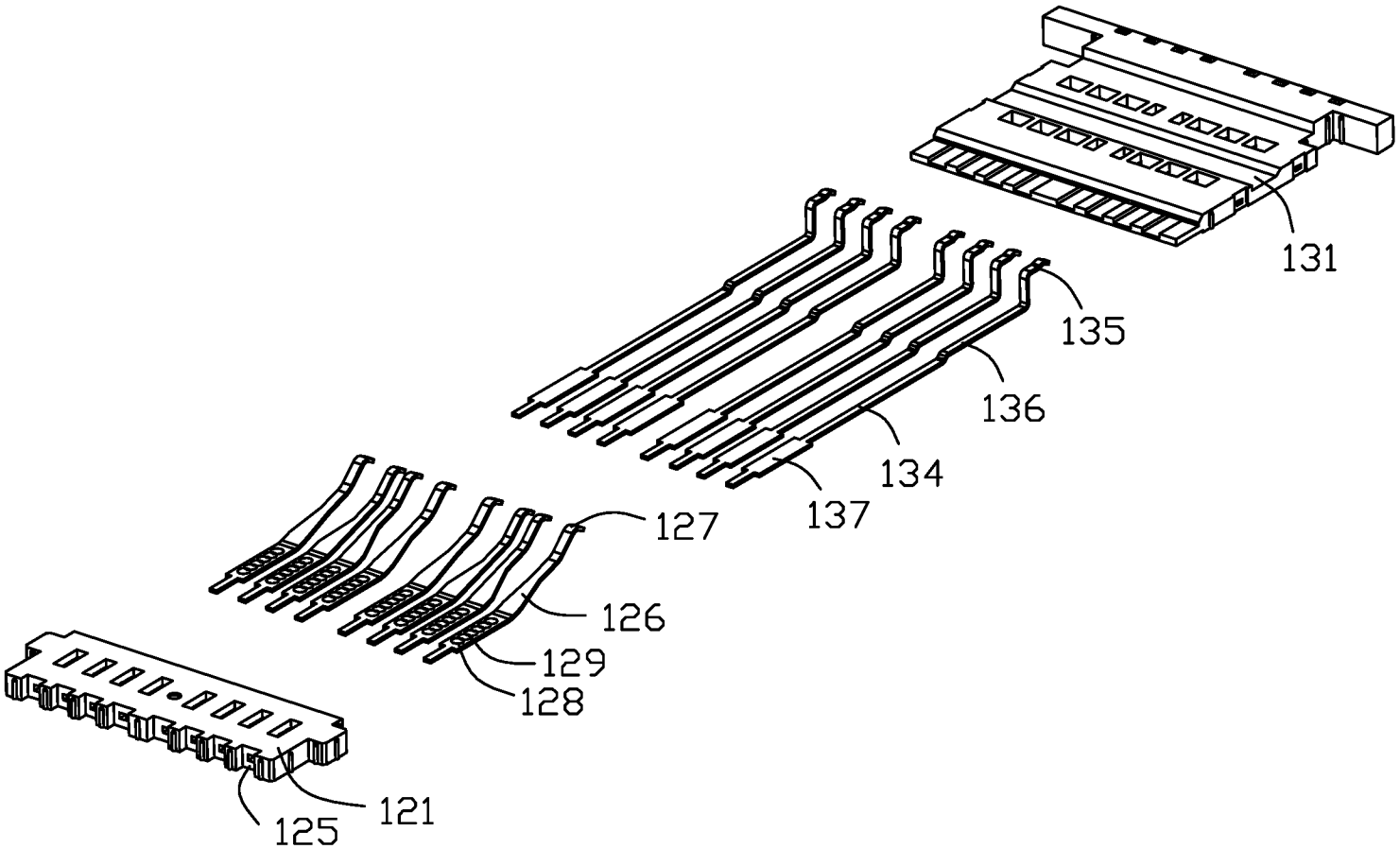
FIG. 11 is an exploded view of a first and a second terminal modules of the varied electrical connector in FIG. 10.
Figure 12:
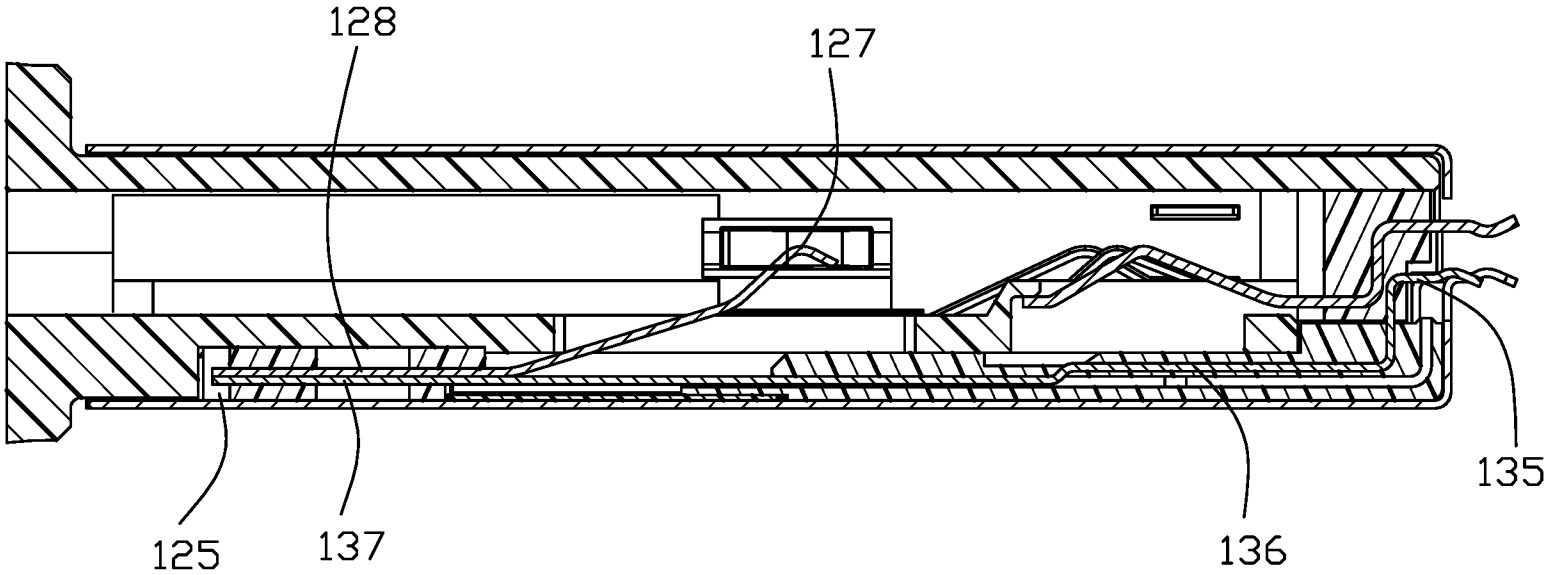
FIG. 12 is a cross-sectional view, similar to FIG. 9, of the varied electrical connector in FIG. 10.

FIGS. 10-12 shows a varied design of the electrical connector in which coupling structure between a first terminal module 120 and a second terminal module 130 is modified. The first terminal module 120 includes an insulative base 121 and a plurality of terminals 126 secured to the insulative base. The terminal 126 has a resilient contacting portion 127 extending rearwardly and a planar terminating portion 128. The terminating portion 128 is partially exposed through a bottom of an insulative base 121 to define a coupling portion 129. The second terminal module 130 includes an insulative body 131 and a plurality of terminals 134 secured to the insulative body. The terminal 134 has a leg 135, an intermediate securing portion 136, and a terminating portion 137 for spot welding to the coupling portion 129 of the terminal 126 to complete a functional terminal constructed of two parts in order to simplify its manufacturing process. A third terminal module 140 including an insulative body 141 and a plurality of terminals 144 is secured to the insulative body 141. The insulative base 121 has front vertical slots 125 for exposing ends of the terminating portions 128 of the terminals 126 and the terminating portion 137 of the terminals 134.

In a conventional one-piece terminal design, a U-shaped in-turned portion is present which makes it difficult to manufacture as well as to control a height of the contacting portion 27 or 127. Differently, in the instant invention the first terminal module 20 and the second terminal module 30 provide the two-piece design for each contact set having the paired terminal 26 and the terminal 34 working together wherein the terminal 26 essentially rearwardly extends in a cantilevered manner while the terminal 34 extends in a stationary manner. Notably, the terminals 44 of the third terminal module 40 are located behind the terminals 26 and extend forwardly in an opposite cantilevered manner. The opposing cantilevered manners in the front-to-back or mating direction between the terminals 26 and the terminals 44 may provide a counter-balanced arrangement when a mating memory card with or without the card tray is inserted into or withdrawn from the receiving space 11. Understandably, in this embodiment both the terminals 26 and the terminals 44 perform in a simple cantilevered manner. Anyhow, in some alternate situation, such terminal may initially functions in a cantilevered manner while successively functioning like a restrained beam rather than a cantilevered beam.

What is claimed is:

1. An electrical connector comprising:

an insulative housing;

a terminal module received in the insulative housing, the terminal module including an insulative body and a plurality of first contacts secured to the insulative body, each first contact having a leg and a first terminating portion;

a plurality of second contacts received in the insulative housing, each of the plurality of second contacts having a second terminating portion coupled to the first terminating portion of a corresponding first contact and a contacting portion extending from the second terminating portion rearwardly toward the leg of the corresponding first contact; and another terminal module disposed rearwardly of the plurality of second contacts, said another terminal module including a plurality of third contacts extending forwardly in the insulative housing toward the plurality of second contacts.

2. The electrical connector as claimed in claim 1, further comprising an insulative base secured to the insulative body of the terminal module, and wherein the plurality of second contacts are secured to the insulative base.

3. The electrical connector as claimed in claim 1, wherein the second terminating portion of each second contact is welded to the first terminating portion of a corresponding first contact.

4. The electrical connector as claimed in claim 1, further comprising an insulative base molded to the coupled second and first terminating portions.

5. An electrical connector comprising:

an insulative housing forming a receiving space forwardly exposed to an exterior along a front-to-back direction;

a plurality of front row contacts integrally formed with an insulative base in the housing, each of said front row contacts having a terminating portion and a deflectable contacting portion fully located behind and directly rearwardly extending from the terminating portion along the front-to-back direction in a cantilevered manner and into the receiving space; and a plurality of supporting terminals retained in the housing in a stationary manner; wherein each of said supporting terminals has a terminating portion mechanically and electrically connected to the terminating portion of the corresponding one of the front row contacts in a vertical direction perpendicular to the front-to-back direction.

6. The electrical connector as claimed in claim 5, wherein each of the supporting terminals includes a leg exposed outside of the housing for mounting to a printed circuit board.

7. The electrical connector as claimed in claim 5, further including a plurality of rear row contacts retained in the housing, wherein each of said rear row contacts is located behind the front row contacts in the front-to-back direction and extends forwardly in another cantilevered manner and into the receiving space.

8. The electrical connector as claimed in claim 5, wherein said another terminating portions of the supporting terminals are located on an outer side of the housing in comparison with the front row contacts in the vertical direction.

9. The electrical connector as claimed in claim 5, wherein said supporting terminals are indirectly retained to the housing via an insulative body on which said supporting terminals are integrally formed via an insert-molding process.

10. The electrical connector as claimed in claim 9, further including a plurality of rear row contacts located behind the front row contacts, extending forwardly in another cantilevered manner and into the receiving space, and integrally formed with another insulative body.

11. The electrical connector as claimed in claim 10, wherein the insulative body retaining the supporting terminals, is secured to said another insulative body retaining the rear row contacts.

12. The electrical connector as claimed in claim 9, wherein said insulative base and said insulative body are secured to each other.

13. The electrical connector as claimed in claim 9, wherein said insulative body is assembled to a bottom of the housing.

14. The electrical connector as claimed in claim 5, wherein the terminating portion of the front row contact and the another terminating portion of the corresponding supporting terminal are either welded together or abut against each other without permanent fixation therebetween.

15. An electrical connector comprising:

an insulative housing defining a receiving space forwardly communicating with an exterior along a front-to-back direction;

a plurality of front row contacts retained in the housing, each of said front row contacts including a terminating portion and a deflectable contacting portion located behind and fully directly rearwardly extending from the terminating portion along the front-to-back direction in a cantilevered manner and into the receiving space;

a plurality of rear row contacts located behind the front row contacts and retained in the housing, each of said rear row contacts including a forwardly extending contacting portion in another cantilevered manner and into the receiving space; and a plurality of supporting terminals retained in the housing in a stationary manner;

wherein each of said supporting terminals has a terminating portion mechanically and electrically connecting to the terminating portion of the corresponding one of said front row contacts; wherein said cantilevered manner and said another cantilevered manner are opposite to each other in the front-to-back direction.

16. The electrical connector as claimed in claim 15, wherein the front row contacts are integrally formed with an insulative base by insert-molding, the rear row contacts are integrally formed with an insulative body by insert-molding, and the supporting terminals are integrally formed with another insulative body by insert-molding.

17. The electrical connector as claimed in claim 16, wherein said insulative base, said insulative body and said another insulative body are secured to one another.

* * * * *